US007661174B2

(12) United States Patent
Park

(10) Patent No.: US 7,661,174 B2
(45) Date of Patent: Feb. 16, 2010

(54) HAIR BRUSH FOR HOT CURLING

(75) Inventor: Young Ho Park, Seoul (KR)

(73) Assignee: Sang Shin Industrial Co., Ltd., Namyangju-Si (KR)

( * ) Notice: Subject to any disclaimer, the term of this patent is extended or adjusted under 35 U.S.C. 154(b) by 808 days.

(21) Appl. No.: 11/365,202

(22) Filed: Feb. 28, 2006

(65) Prior Publication Data

US 2007/0174986 A1 Aug. 2, 2007

(30) Foreign Application Priority Data

Jan. 31, 2006 (KR) ..... 10-2006-0009403

(51) Int. Cl.
*A46B 3/18* (2006.01)
*A46B 9/08* (2006.01)

(52) U.S. Cl. ..... 15/206; 15/160; 15/168; 132/120; D4/128

(58) Field of Classification Search ..... 15/160, 15/168, 206; 132/120, 218; D4/127, 128, D4/130–134
See application file for complete search history.

(56) References Cited

U.S. PATENT DOCUMENTS 4,167,192 A * 9/1979 Arnold ..... 132/212
5,161,554 A * 11/1992 Fitjer ..... 132/218
5,649,851 A * 7/1997 Boucherie ..... 451/139
5,887,600 A * 3/1999 Wilk ..... 132/262
5,911,226 A * 6/1999 Vecchiola et al. ..... 132/211
D461,316 S 8/2002 Park
D467,737 S 12/2002 Park
2003/0070244 A1* 4/2003 McEntyre et al. ..... 15/160

FOREIGN PATENT DOCUMENTS

JP 7-236518 * 9/1995

* cited by examiner

*Primary Examiner*—Mark Spisich
(74) *Attorney, Agent, or Firm*—Schmeiser, Olsen & Watts LLP

(57) ABSTRACT

A hairbrush for hot curling. A brush body constituting a hairbrush is formed to have a substantially quadrangular sectional shape with rounded corners to thereby shorten a hair drying time and improve hair curling efficiency. A slippage prevention part is formed on the outer surface of each steel wire constituting a core element to increase frictional force between bristles and the steel wire, maintain the firmly fastened state of the bristles for an extended period of time and lengthen the lifetime of the hairbrush. A rounded part is formed on each end of each bristle through grinding to prevent damage to the skin of the head, ensure smooth combing of hair and increase the value of the hairbrush.

1 Claim, 5 Drawing Sheets

【FIG. 1】
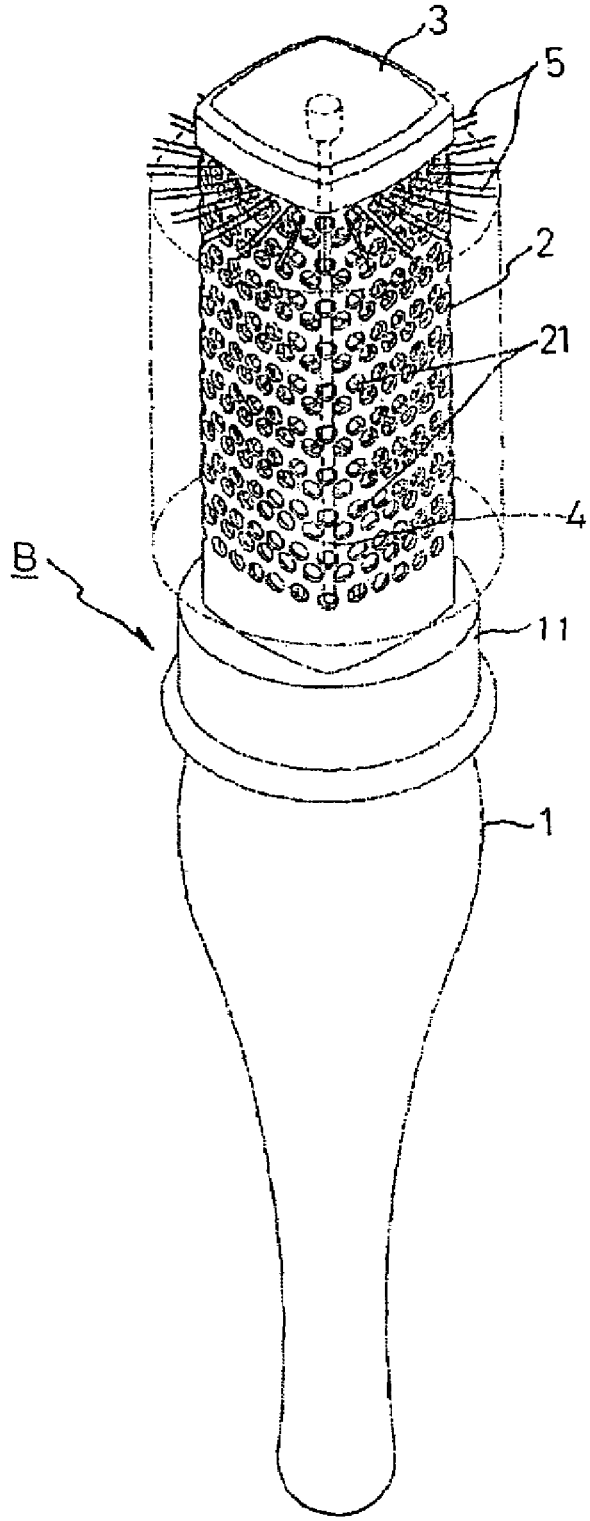

【FIG. 2】
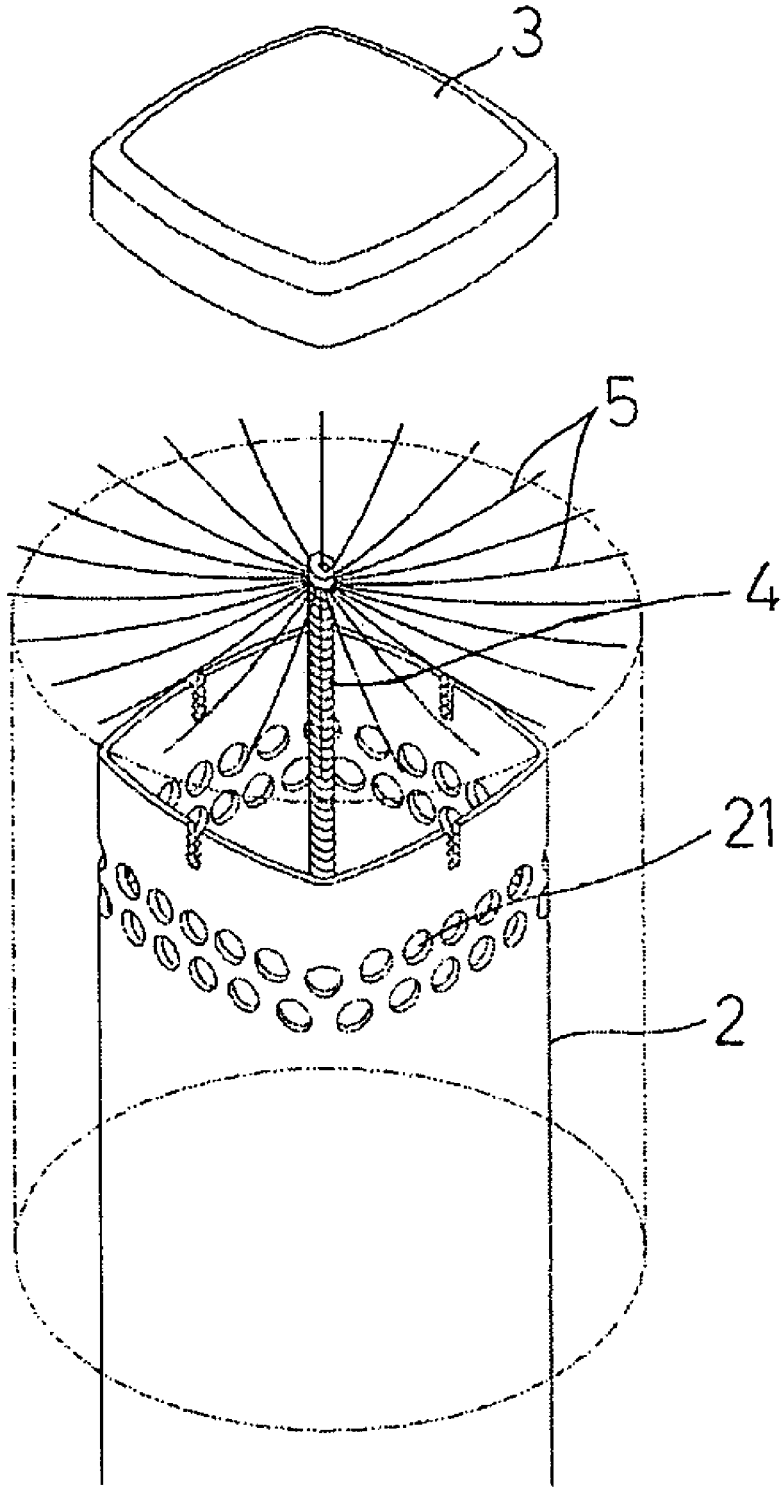

【FIG. 3】
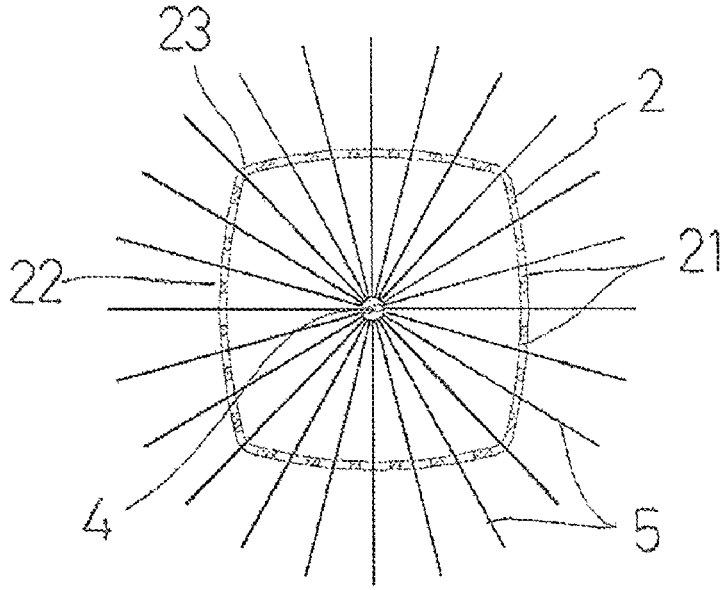
【FIG. 4】
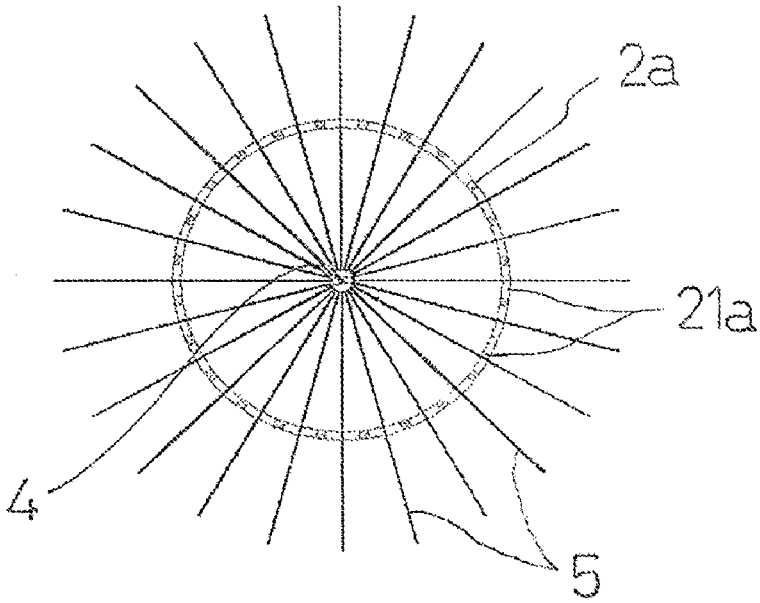
Related Art

【FIG. 5】
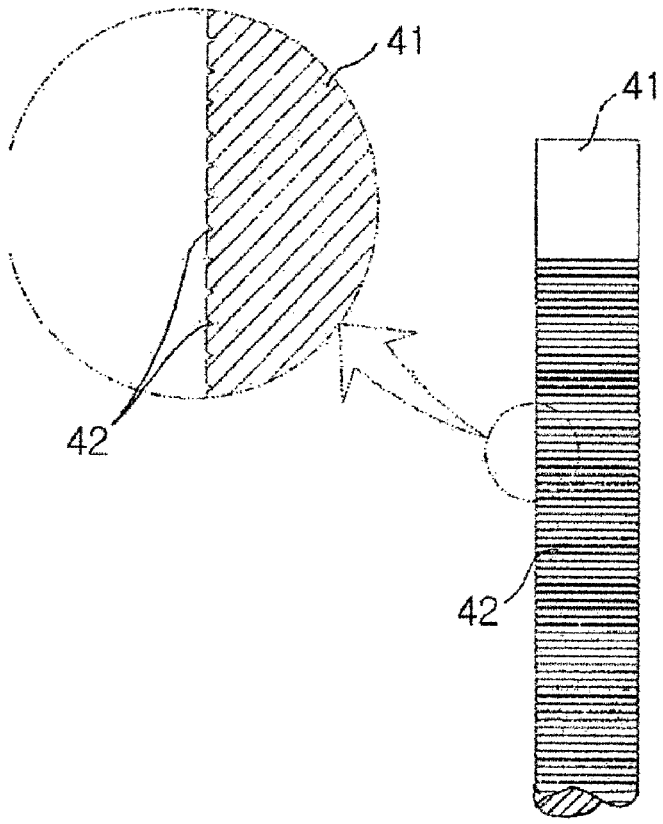
【FIG. 6】
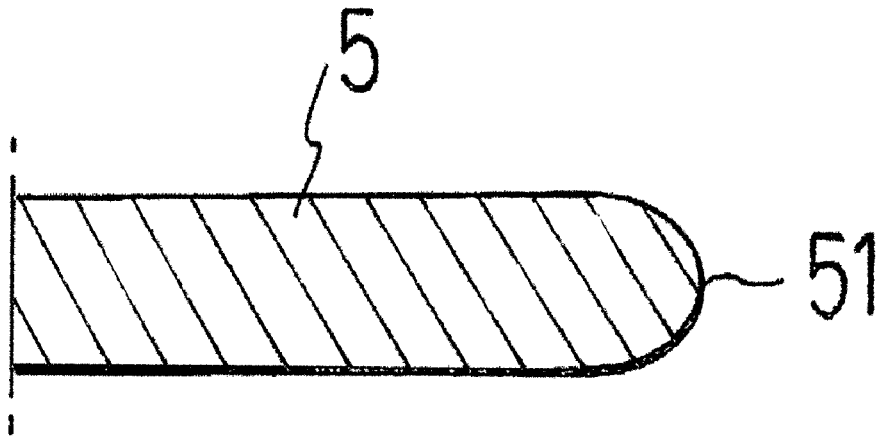

【FIG. 7a】
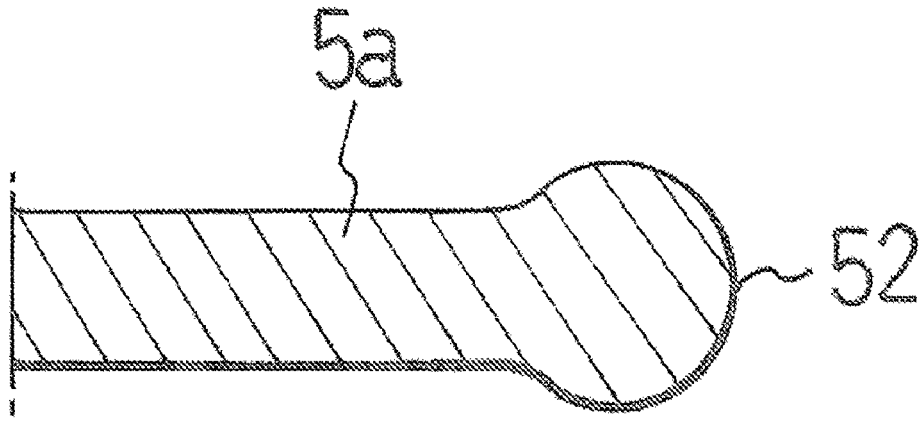
Related Art
【FIG. 7b】
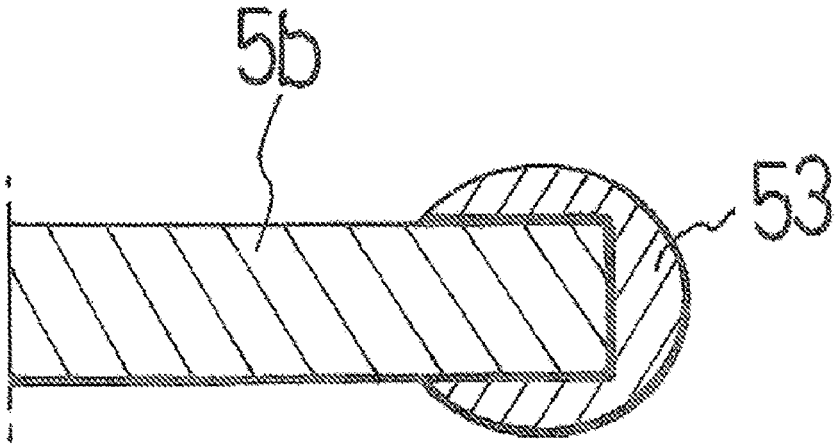
Related Art

HAIR BRUSH FOR HOT CURLING

BACKGROUND OF THE INVENTION

1. Field of the Invention

The present invention relates, in general, to a hairbrush for hot curling, and more particularly, to a hairbrush for hot curling, in which a brush body is formed to have a substantially quadrangular sectional shape with rounded corners to thereby shorten a hair drying time and improve hair curling efficiency, a slippage prevention part is formed on the outer surface of a core element used for fastening bristles to firmly fasten the bristles and lengthen the lifetime of the hairbrush, and a rounded part is formed on each end of each bristle to prevent damage to the skin of the head and ensure smooth combing of hair.

2. Description of the Related Art

As is generally known in the art, a hairbrush for hot curling is used along with a hair dryer to quickly dry wet hair and form waves as desired.

A conventional hairbrush for hot curling comprises a handle having an appropriate length and a predetermined shape, a tubular brush body made of aluminum, secured to the upper end of the handle and defined with a plurality of holes at regular intervals, an end cover fitted into the upper end of the brush body, a core element formed by twisting two steel wires and fixedly installed between the handle and the end cover to be positioned centrally in the brush body, and bristles fastened between the two steel wires and projecting outside through the holes of the brush body.

When using the conventional hairbrush for hot curling, constructed as mentioned above, with hair twined around the brush body, a stream of hot air is emitted from a hair dryer toward the twined portion of the hair. At this time, as hot air is directed toward the hair which is divided by the bristles of the hairbrush, the hot air is introduced into and then discharged out of the brush body and increases the temperature of the brush body to a predetermined level, as a result of which wet hair can be dried in a short period of time and waves can be formed as desired by a user.

However, the conventional hairbrush used for hot curling has a problem in that it has inferior heat efficiency.

That is to say, when drying or curling hair, the user grasps the hairbrush using one hand and approaches the hot air discharging port of a hair dryer to the brush body of the hairbrush using the other hand to direct hot air to the hair. At this time, since the brush body has a circular sectional shape, heat is applied concentratedly only to the portion of the hair which adjoins the hot air discharging port of the hair dryer. Thus, it takes a long time to completely dry the hair, and a substantial period of time is required to curl the hair and form desired waves.

Also, the conventional hairbrush suffers from defects in that, since the bristles are easily released from the core element, the lifetime of the hairbrush is shortened.

The bristles are fastened in a manner such that bristles cut to a predetermined length are arranged between two steel wires constituting the core element and the two steel wires are twisted to fasten the bristles between them. Nonetheless, when using the hairbrush, since hot air of about 170° C. emitted from the hair dryer directly heats the bristles, the bristles having a softening point of about 180° C. are easily released from the core element even with external application of small tensile force, thereby shortening the lifetime of the hairbrush.

Another problem of the conventional hairbrush is in that the distal end of each bristle is so sharp that the damage to the skin of the user's head may be caused.

In this regard, the bristles are formed by cutting a bristle material wound on a reel, etc. to a predetermined length. However, since the cut end of each bristle is sharp, the damage to the skin of the head may be caused, and because smooth combing of hair cannot be ensured, the value of the hairbrush is degraded.

SUMMARY OF THE INVENTION

Accordingly, the present invention has been made in an effort to solve the problems occurring in the related art, and an object of the present invention is to provide a hairbrush for hot curling which can shorten a hair drying time and improve hair curling efficiency, thereby minimizing electric power consumption and maximizing heat efficiency.

Another object of the present invention is to provide a hairbrush for hot curling which can firmly fasten bristles, thereby considerably lengthening the lifetime of the hairbrush.

Still another object of the present invention is to provide a hairbrush for hot curling which can prevent damage to the skin of the head and ensure smooth combing of hair.

In order to achieve the above objects, in the present invention, a brush body constituting a hairbrush is formed to have a substantially quadrangular sectional shape with rounded corners to thereby shorten a hair drying time and improve hair curling efficiency, a slippage prevention part is formed on the outer surface of each steel wire constituting a core element to increase frictional force between bristles and the steel wire, maintain the firmly fastened state of the bristles for an extended period of time and lengthen the lifetime of the hairbrush, and a rounded part is formed on each end of each bristle through grinding to prevent damage to the skin of the head, ensure smooth combing of hair and increase the value of the hairbrush.

BRIEF DESCRIPTION OF THE DRAWINGS

The above objects, and other features and advantages of the present invention will become more apparent after a reading of the following detailed description when taken in conjunction with the drawings, in which:

FIG. 1 is a perspective view illustrating a hairbrush in accordance with an embodiment of the present invention;

FIG. 2 is an exploded perspective view illustrating the main parts of the hairbrush in accordance with the present invention;

FIG. 3 is a transverse cross-sectional view illustrating a brush body to which the present invention is applied;

FIG. 4 is a transverse cross-sectional view illustrating a brush body which constitutes a conventional hairbrush;

FIG. 5 is a partially enlarged front view illustrating a steel wire used for constituting a core element according to the present invention;

FIG. 6 is an enlarged cross-sectional view illustrating a bristle to which the present invention is applied; and FIGS. 7*a* and 7*b* are enlarged cross-sectional views illustrating bristles of the conventional hairbrush.

DETAILED DESCRIPTION OF PREFERRED EMBODIMENTS

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a perspective view illustrating a hairbrush in accordance with an embodiment of the present invention, and FIG. 2 is an exploded perspective view illustrating the main parts of the hairbrush in accordance with the present invention.

A hairbrush 'B' according to the embodiment of the present invention is constructed in the same manner as that of the conventional art in that it comprises a handle 1 formed with a connection section 11 and having an appropriate length and a predetermined shape, a tubular brush body 2 made of aluminum, secured to the connection section 11 of the handle 1 and defined with a plurality of holes 21 at regular intervals, an end cover 3 fitted into the upper end of the brush body 2, a core element 4 formed by twisting two steel wires and fixedly installed between the handle 1 and the end cover 3 to be positioned centrally in the brush body 2, and bristles 5 fastened between the two steel wires of the core element 4 and projecting outside through the holes 21 of the brush body 2.

A first characterizing feature of the present invention is in that, as shown in FIG. 3, the brush body 2 is formed to have a substantially quadrangular hollow configuration which has four arc-shaped side parts 22 and four rounded corner parts 23.

In this construction, when using the hairbrush 'B', with hair twined around the brush body 2, a stream of hot air is emitted from a hair dryer toward the brush body 2 to dry and curl the hair.

FIG. 4 is a transverse cross-sectional view illustrating a circular brush body 2*a* of a conventional hairbrush which is compared with the brush body 2 according to the present invention. When the hair dryer is brought toward the conventional brush body 2*a*, only a portion of the conventional brush body 2*a* which is close to the hot air outlet of the hair dryer is concentratedly heated, and the other portions of the conventional brush body 2*a* which are not close to the hot air outlet of the hair dryer are abruptly reduced in temperature. Therefore, an extended period of time is required to properly dry and curl the hair, whereby electric power consumption is increased and heat efficiency is degraded.

However, in the present invention, with wet hair twined around the brush body 2, when a user brings the hot air discharge port of the hair dryer close to the arc-shaped side part 22, that is, the bulged side part 22, as hot air is distributed over a wide area of the bulged side part 22, hair drying efficiency can be maximized. At this time, as a part of hot air is introduced into and discharged out of the brush body 2 through the holes 21, heat transfer is promoted and hair drying efficiency can be further improved.

Also, when the user brings the hot air outlet of the hair dryer close to the rounded corner part 23 of the brush body 2, since only the rounded corner part 23 is concentratedly heated, hair curling efficiency can be improved. Consequently, it is possible to form a wave as desired by the user within a short period of time.

A second characterizing feature of the present invention is in that, as shown in FIG. 5, a slippage prevention part 42 is formed on the outer surface of each steel wire 41 constituting the core element 4.

The core element 4 is formed in a manner such that bristles 5 are arranged side by side between two steel wires 41 cut to a predetermined length, and both ends of the core element 4 are twisted in opposite directions to fasten the bristles 5 between the two steel wires 41.

In particular, in the present invention, due to the fact that the slippage prevention part 42 is formed on the outer surface of each steel wire 41, the bristles 5 can be firmly fastened between the two steel wires 41.

In this regard, because the bristles 5 made of synthetic resin has a predetermined level of elasticity, they are slightly compressed between the two steel wires 41. In this state, when heat is transferred from the hair dryer to the bristles 5, the bristles 5 as a whole become softer and are likely to be easily released from between the two steel wires 41.

However, in the present invention, due to the fact that the slippage prevention part 42 is formed on each steel wire 41, when the bristles 5 are slightly compressed by the compression force of the steel wires 41, a portion of each bristle 5 is compressively inserted into the slippage prevention part 42. Accordingly, as frictional force is increased between the bristle 5 and the steel wire 41, the bristle 5 can be firmly fastened between them and has tension-resistant force which is larger than that of the conventional bristle.

While it is illustrated in the drawing that the slippage prevention part 42 comprises fine grooves defined on the outer surface of each steel wire to extend in a horizontal direction, it is to be readily understood that these fine grooves can be easily defined by a knurling tool and may be formed to extend in a vertical direction or an oblique direction or to form the shape of a lattice. Even in this case, the same effects as described above can also be obtained.

A third characterizing feature of the present invention is in that, as shown in FIG. 6, a rounded part is formed on each end of each bristle 5. In other words, the end of each bristle 5 cut to a pre-selected length is grinded to form a rounded head part 51.

FIGS. 7*a* and 7*b* illustrate bristles 5*a* and 5*b* of the conventional hairbrush. Namely, in the conventional art, in an effort to prevent damage to the skin of the head and ensure smooth combing of hair, as shown in FIG. 7*a*, heat is applied to an end of the bristle 5*a* to partly melt the bristle 5*a*, whereby the end of the bristle 5*a* is formed in the shape of a water droplet due to contraction force and surface tension of the bristle 5 itself. Then, by cooling the end of the bristle 5*a*, a water droplet-shaped head part 52 is formed on the end of the bristle 5*a*. Also, as shown in FIG. 7*b*, by dipping the end of the bristle 5*b* into a container filled with epoxy resin fluid, epoxy resin is set on the end of the bristle 5*b*, and an epoxy head part 53 is formed on the end of the bristle 5*b*.

However, in the former case, precise administration of process conditions including a temperature of a heating source for melting the bristle 5*a*, a distance between the heating source and the bristle 5*a*, a heating time, etc. are required, and finally formed head parts 52 cannot have a uniform size. Therefore, marketability of the hair brush may be deteriorated.

Further, in the latter case, epoxy resin is separately needed, a substantial time is required to set the epoxy resin, and the epoxy head part 53 may be easily detached from the bristle 5*b* due to repetitive vibration, shock, temperature difference, etc. Hence, the lifetime of the hairbrush cannot but be shortened.

On the contrary, in the present invention, since the rounded head part 51 is formed on each end of each bristle 5 by grinding, the likelihood of the skin of the head to be damaged by a sharp cut surface is inherently avoided, and smooth combing of hair is ensured, whereby the preference of the hairbrush according to the present invention can be elevated.

As is apparent from the above descriptions, the hairbrush for hot curling according to the present invention provides advantages in that, since a brush body constituting a hairbrush is formed to have a substantially quadrangular sectional shape with rounded corners, hair can be quickly dried and curled, whereby a hair drying time can be shortened and hair curling efficiency can be improved. Also, due to the fact that a slippage prevention part is formed on the outer surface of each steel wire constituting a core element, bristles can be firmly fastened between two steel wires, whereby it is possible to increase frictional force between bristles and the steel wires, maintain the firmly fastened state of the bristles for an extended period of time and lengthen the lifetime of the hairbrush. Further, because a rounded part is formed on each end of each bristle through grinding, damage to the skin of the head is prevented, smooth combing of hair is ensured, and the value of and preference for the hairbrush is increased.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A hairbrush for hot curling, comprising:

a handle formed with a connection section;

a tubular brush body made of aluminum, secured to the connection section and defined with a plurality of holes;

a core element formed by twisting two steel wires and fixedly installed between the handle and an end cover fitted into an upper end of the brush body; and bristles having a predetermined length, fastened between the two steel wires of the core element and projecting outside through the holes of the brush body, wherein the brush body is formed to have a substantially quadrangular hollow configuration with arc-shaped side parts and rounded corner parts.

* * * * *